US005980238A

United States Patent [19]

Collins, Sr.

[11] Patent Number: 5,980,238

[45] Date of Patent: Nov. 9, 1999

[54] GAS LIGHT ASSEMBLY

[76] Inventor: James C. Collins, Sr., 525 Indian Acres Ct., Tucker, Ga. 30084

[21] Appl. No.: 09/078,220

[22] Filed: May 13, 1998

[51] Int. Cl.[6] ..... F23Q 7/12

[52] U.S. Cl. ..... 431/18; 431/255; 431/74

[58] Field of Search ..... 431/18, 72, 71, 431/74, 255, 6; 362/175

[56] References Cited

U.S. PATENT DOCUMENTS 5,478,232 12/1995 Dillinger et al. ..... 431/18
5,503,549 4/1996 Iasella ..... 431/18

*Primary Examiner*—Carroll Dority
*Attorney, Agent, or Firm*—Womble Carlyle Sandridge Rice, PLLC

[57] ABSTRACT

A gas light assembly having an electronic control system that monitors the surrounding ambient light conditions to detect the transition from a light to a dark state is disclosed. Upon detection of the transition of the ambient light to a dark state, the electronic control system opens a gas flow control valve to allow the flow of gas from a gas supply line through a mixing chamber wherein the gas is mixed with air to form a combustible gas mixture that passes through a venturi tube and a burner head assembly, exiting the burner head assembly at mantels. A spark is generated to ignite the combustible gas mixture passing out of the mantels, and a sensor detects and verifies the ignition of the combustible gas mixture at the mantels so as to verify to the system that the lamp of the gas light assembly is lit during dark conditions and is unlit and the flow of gas shut off during light conditions.

12 Claims, 9 Drawing Sheets

GAS LIGHT ASSEMBLY

FIELD OF THE INVENTION

The present invention relates to a gas light assembly. In particular, the present invention relates to a gas light assembly wherein the supply of gas and the ignition of the gas by the gas light are monitored and automatically controlled based on ambient light conditions to ensure that the gas light is lit during low light or dark conditions, and is unlit in light conditions.

BACKGROUND OF THE INVENTION

In the past, conventional gas light assemblies typically have included two or more mantels suspended from a gas manifold or burner head into which a combustible mixture of air and an illuminating gas, such as natural gas or propane, is fed. This combustible mixture is burned as it exits the mantels of the burner head to provide illumination. Typically, such gas light assemblies were constructed to remain continuously lit during both day and night. As a result, these gas light assemblies tended to waste a significant amount of gas by burning during daylight hours when the illumination of the gas light is not required, as well as significantly shortening the service life of the mantels and burner tips of the gas light assembly.

More recently, gas lamps or lighting assemblies have been provided with electrical control systems that can control the supply of gas to the burner head and mantels of the lamp based on ambient light conditions, and which include an automatic sparking device or ignitor for igniting the gas. For example, U.S. Pat. No. 4,830,606 discloses an electrical control system having an ignitor for each mantel of the lamp, with each ignitor being fired on a daily basis upon the opening of an electrically controlled gas control valve. Likewise, U.S. Pat. No. 5,478,232 discloses an ambient light controlled outdoor gas light having sensors for detecting light and dark ambient conditions and for detecting whether or not the lamp is already lit. A photoelectric cell alerts a comparator within a control circuit to a dark ambient condition. In response, the gas control valve is opened and the sparking device activated so as to create a spark to ignite the air-gas mixture.

A problem with such automatically controlled gas light systems generally has been that these systems have no mechanism for actively monitoring the several components of the system in addition to simply detecting a change between light and dark ambient light conditions. For example, such prior automatically controlled gas lights typically do not have a mechanism for monitoring battery life to determine if there is sufficient voltage in the battery of the system to activate the sparking device and to shut the system down prior to opening the gas control valve in this event. As a result, such systems tend to first open the gas valve and leave the gas valve open while attempting to create a spark even when the power in the battery is too low to generate a spark, for example when the battery needs replacing. This has led to a significant waste of gas, as well as creating a potentially dangerous situation by allowing gas to build up within the light fixture. Also, such prior gas light assemblies typically are designed for a specific burner head arrangement or primarily for new installations, and therefore cannot be used with a variety of different burner head arrangements or retrofit to old lamp assemblies, and are difficult to install.

Accordingly, it can be seen that a need exists for an improved gas light assembly that automatically monitors the surrounding ambient light conditions to ignite the gas light assembly in low light or dark conditions, and to turn off the gas light assembly during light conditions, for example, daylight, and which monitors the components of the system to hold the gas control valve of the gas light assembly in a closed position if a fault condition is detected in order to conserve gas and avoid a potentially dangerous build-up of gas in the light fixture, and to also provide such an improved gas light assembly which is reliable, safe, and easy to install with existing or new gas lights.

SUMMARY OF THE INVENTION

Briefly described, the present invention relates to a gas light assembly with automatic control based on ambient light conditions, and which monitors the gas light assembly to automatically shut off gas flow to the assembly upon the detection of a fault condition. The gas light assembly thus comprises an outdoor lamp or light that is mounted on a support pole and is connected to a gas supply via a gas supply line. The gas light assembly bums a combustible mixture of propane, butane, natural gas or other suitable fuels and air mixture to provide illumination to a surrounding area in which the gas light assembly is mounted. The flow of the natural gas or other fuel through the gas supply line is controlled by an electronically controlled gas control valve that is actuated by a micro-controller which opens the gas valve during dark conditions during which time the gas light assembly is lit, and closes the gas valve during light conditions or upon the detection of a fault condition within the assembly.

The gas light assembly includes a lamp or lantern frame which encloses a burner head having a series of mantels at which the combustible mixture of air and gas is burned. A gas inlet assembly connects the burner head to the gas supply line and includes a venturi tube, an air/gas mixing chamber mounted between the venturi tube and the gas supply line, and an ignitor ring mounted between the venturi tube and the burner head. The ignitor ring has a series of slits defined about its periphery through which a portion of the combustible mixture is permitted to escape or pass as the combustible mixture is flowing through the burner head and to the mantels. A sparking device, typically an electrode, is positioned adjacent the slits of the ignitor ring and selectively provides a spark for igniting the combustible mixture escaping from the slits. This ignition of the combustible mixture at the slits in turn causes the combustible mixture flowing through the mantels to be ignited. Once the mantels are lit, their consumption of the combustible mixture together with the flow characteristics of the venturi tube and ignitor ring, which force the combustible mixture therethrough tends to extinguish the ignition of the air-gas mixture at the slits and results in no further combustion thereof at the ignitor ring slits.

An adapter collar is provided for mounting the gas light assembly to a support pole or post. The adapter collar is configured with an upper end that is adapted to receive the lamp or lantern frame, and a spaced lower end having an enlarged diameter adapted to fit over and be seated upon the support post. The adapter collar is configured to receive various sized support posts to enable the gas light assembly of the present invention to be used in new assemblies, or as a retrofit assembly to replace conventional, existing gas light assemblies. Mounted within the upper portion of the adapter collar is an electronic control system for the gas light assembly and the gas supply line. The electronic control system includes the microprocessor-based micro-controller for controlling the gas flow and ignition of the combustible mixture based on detected ambient light conditions.

The micro-controller of the control system has a memory and a self-monitoring circuit with an auto reset for monitoring the operational state of the system and to reset the system automatically upon detection of a fault condition. A solar cell is mounted to the exterior of the adapter collar and is connected to the micro-controller. The solar cell detects ambient light conditions and provides input signals to the micro-controller for setting light and dark states or threshold levels in the memory of the micro-controller for operation of the gas light assembly. The micro-controller controls both the gas control valve and the sparking device to cause the gas control valve to open to release a flow of gas and engages the sparking device upon detection of the dark state, and closes the gas control valve in response to the detection of a light condition or state. The micro-controller is powered by a re-chargeable battery or a similar power source connected to the micro-controller and to the solar cell. The micro-controller monitors the charge or voltage of the battery via a battery monitoring circuit, and engages the gas control valve to shut off the gas flow when a low battery charge state is detected, and further initiates the charging of the battery through the solar cell.

Infrared detectors or sensors, such as photo transistors, are mounted within the lamp of the gas light assembly in a position spaced a sufficient distance from the mantels to detect a lighted or unlit condition of the mantels based on levels of infrared radiation given off by the mantels. The infrared sensors are connected to the micro-controller via an ignition verification circuit that reports the existence of the lighted or unlighted condition of the mantels to the micro-controller. When the mantels are detected to be unlit when they should be lit, an ignition sequence is activated. During the ignition sequence, the micro-controller activates the sparking device a pre-programmed number of times during a sparking cycle. If the mantels are still detected to be unlit after the sparking cycle times out, the ignition sequence is re-activated and after a pre-determined number of unsuccessful attempts to ignite the gas light assembly, the ignition sequence is terminated and the gas control valve is closed to shut off the gas flow until the system cycles from a dark state to a light state and back to a dark state. Further, the micro-controller continually monitors the aforementioned components of the gas light assembly and the voltage or charge levels of the battery, as well as the ambient light conditions and the lit or unlit condition of the mantels, and automatically resets itself upon detection of a fault condition to minimize the wasting of gas or fuel, and to ensure the safe, efficient, and continued operation of the gas light assembly.

Accordingly, it is an object of the present invention to provide an improved gas light assembly that is automatically controlled based on ambient light conditions.

Another object of this invention is to provide an outdoor gas light assembly that is inexpensive to manufacture, and is easy to install in both new and existing outdoor gas lights.

Still another object of the present invention is to provide an automatically controlled gas light assembly with a self-monitoring capability which shuts down gas flow to minimize the wasting of gas or fuel in response to the detection of a fault condition.

Yet another object of the present invention is to provide an automatically controlled gas light assembly that automatically monitors power levels for the assembly, and initiates a charging sequence to re-charge the power source of the assembly upon the detection of a low charge state.

An additional object of the invention is to provide a gas light assembly that will automatically shut off the flow of gas after a predetermined number of unsuccessful attempts to light the gas light assembly have occurred.

A further object of the invention is to provide an automatically controlled gas light assembly that uses a minimal amount of electricity during operation and requires minimal maintenance.

Another object of the invention is to provide an automatically controlled gas light assembly having an automatic reset circuit for resetting the system upon detection of a fault condition.

Various other objects, features and advantages of the present invention will become apparent to those skilled in the art upon reading the following detailed description, when taken in conjunction with the accompanying drawings.

DETAILED DESCRIPTION

Figure 1:
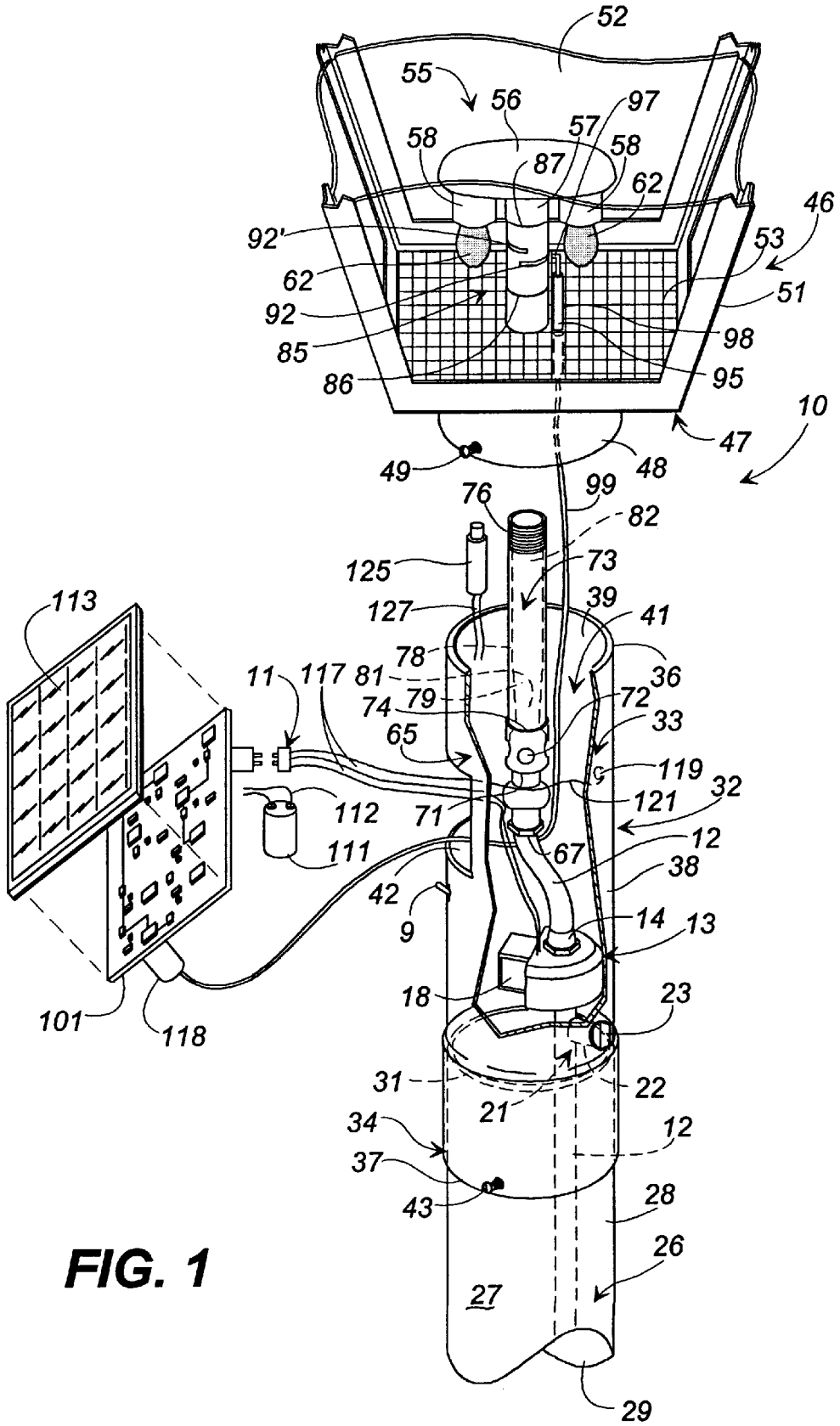
FIG. 1 is an exploded perspective view of preferred embodiment of gas light assembly of the present invention.
Figure 2:
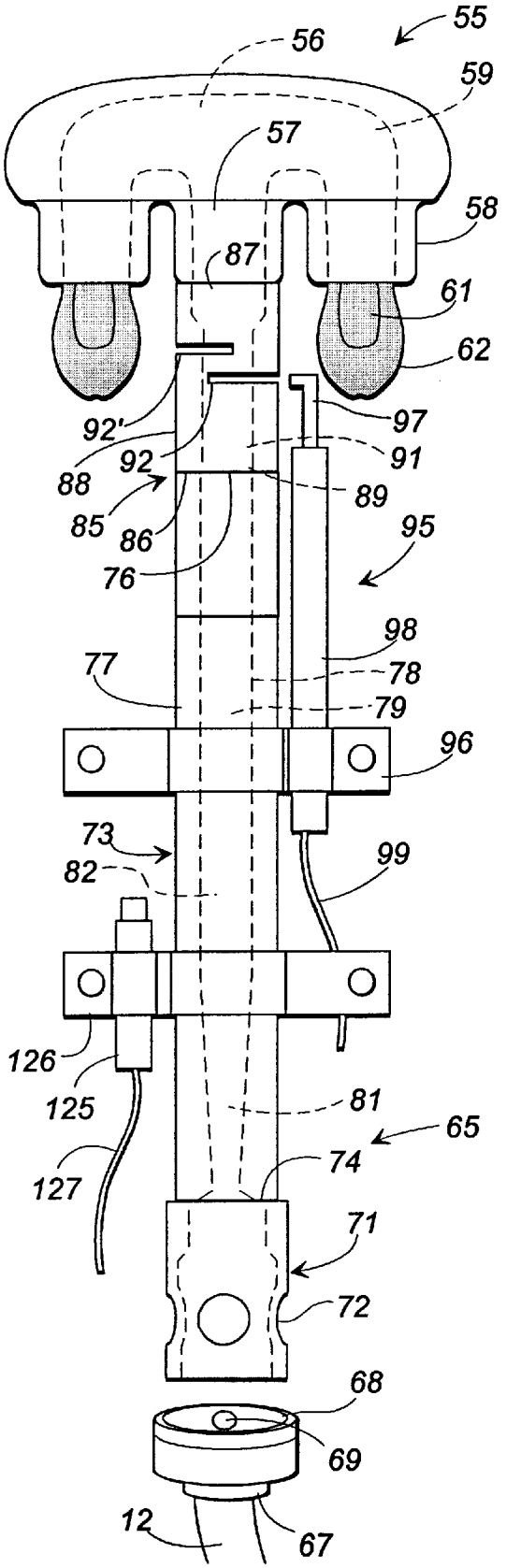
FIG. 2 is a side elevational view of the burner head and ignition assembly of the gas light assembly of FIG. 1.
Figure 3:
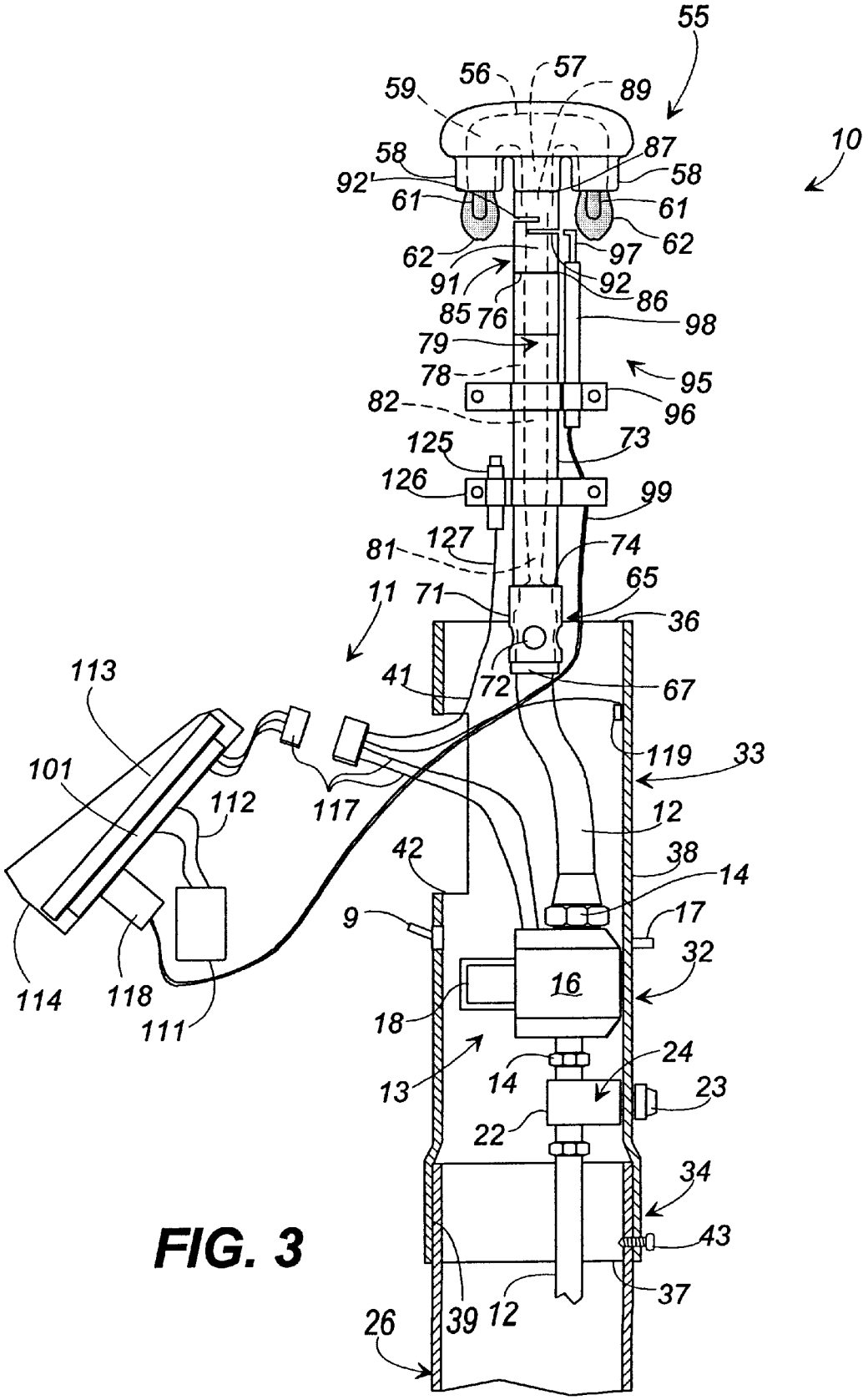
FIG. 3 is a side elevational view of the solar cell and gas control valve of the gas light assembly of FIG. 1.

Referring now to the drawings in greater detail in which like numerals indicate like parts throughout the several views, FIGS. 1–3 illustrate the gas light assembly 10 of the present invention. The gas light assembly includes an electronic control system, generally indicated by numeral 11, which controls the gas light assembly based on ambient light conditions by monitoring the ambient light of the surrounding area in which the gas light assembly is mounted, and is constructed to ignite the gas light assembly during dark ambient light conditions, and to turn off the gas light assembly during light ambient light conditions. The control system also monitors and automatically shuts off the gas light assembly upon the detection of a fault condition. A manual control switch 9 can also be provided on the outside of the gas light assembly for manually or remotely turning the gas light assembly on and off.

The gas light assembly burns a combustible mixture of an illuminating gas, such as propane, butane, natural gas or other suitable fuels and air to provide illumination to the surrounding area in which the gas light assembly is positioned. The illuminating gas is provided to the gas light assembly 10 by a gas supply source (not shown) connected to the gas light assembly via a gas supply line 12 (FIGS. 1 and 3) and is mixed with air to form the combustible mixture.

An electrically controlled gas flow control valve 13 is mounted along and connected to the gas supply line by fittings or connectors 14 for controlling the flow of gas through the gas supply line. The gas control valve generally is a direct current electronically controlled gas valve, such as is commonly manufactured by SIT, designed to operate at a low voltage level, approximately three volts, although other conventional types of electronically controlled gas control valves may also be utilized, as known to those of skill in the art. The gas control valve includes a housing 16 with a manual control switch 17 protruding outwardly from the gas light assembly for manually opening and closing the valve, and a reversible motor 18, such as an electric motor, for controlling the opening and closing of the gas control valve. The gas control valve is linked to and controlled by the electronic control system 11 so as to open and close the gas control valve in response to measured ambient light conditions.

As indicated in FIGS. 1 and 3, a shut-off valve 21 also is mounted on the gas supply line 12, immediately downstream of the gas flow control valve 13. The shut-off valve typically is a conventional mechanical control valve having a valve housing 22 and a control button or switch 23 that protrudes therefrom for mechanically shutting off the flow of gas through the gas supply line. Thus, in the event of an emergency condition, or as otherwise needed, the gas flow can be shut off manually by the actuation of the manual shut-off valve 21.

The gas light assembly 10 of the present invention is designed for use both in new installations or as a retrofit to replace existing gas light assemblies. As illustrated in FIG. 1, therefore, the gas light assembly 10 will include a hollow, substantially upstanding standard or lamp post 26 on which the gas light assembly is supported in a raised position above the ground. The lamp post 26 generally is formed from a metal such as aluminum, steel, or other durable, weather resistant materials, and has an outer continuous side wall 27 and inner continuous side wall 28 defining a hollow inner passage 29 through which the gas supply line 12 extends. An adapter collar 32 mounts over and seats on the upper end 31 of the lamp post 26, and houses the electronic control system 11 and gas control valve 13 of the gas light assembly 10. The adapter collar is a substantially tubular member generally formed from a lightweight, durable material such as aluminum or steel, typically of the same material as the lamp post 26, and is designed to be mounted on a variety of different sized supports or lamp posts to enable the gas light assembly to be used in a variety of retrofit applications, as well as in new installations.

The adapter collar 32 includes an elongated upper portion 33 that typically extends in the range of from eight to twelve inches, and a lower portion 34 that is approximately three to five inches in length having an expanded diameter greater than that of the upper portion, sized to receive the upper end 31 of the lamp post 26 therein, as indicated in FIGS. 1 and 3. The adapter collar further includes an open upper end 36, an open lower end 37, a substantially cylindrical outer side wall 38, and a cylindrical inner side wall 39 defining an open ended passage 41 therethrough. A cut-out 42 or opening is defined in the upper portion 33, adjacent the open upper end 36 of the adapter collar 32. The increased diameter of the lower portion 34 of the adapter collar 32 enables it to receive lamp posts of varying sizes to again enable the gas light assembly 10 to be used both for new installations and as a retrofit to replace conventional, existing gas light assemblies. Set screws 43, or other, similar fasteners, are provided adjacent the lower end 37 of the lower portion 34 of the adapter collar for engaging the upper end 31 of the lamp post 26 received therein for securing the adapter collar to the lamp post.

As FIG. 1 illustrates, a lamp or lantern 46 is received over and mounts on the upper end 36 of the adapter collar 32. The lamp includes a frame 47, here illustrated to be substantially rectangular, but which can also be oval, substantially cylindrical or of other architectural designs as desired. The lamp frame generally is formed from a durable, weather resistant material such as aluminum or steel, typically being formed from the same material as is the adapter collar and the support post. The frame includes a base 48 that seats on and is secured to the upper end 36 of the adapter collar 32 by fasteners such as a set screw 49, and an upper housing 51 that contains a series of transparent windows 52, typically formed from glass, Plexiglas, or similar transparent, weather resistant materials, and a floor 53 generally formed from a metal screen or mesh. The lamp houses a burner head assembly 55 at which the combustible air-gas mixture is combusted for illuminating the surrounding area in which the gas light assembly is mounted.

The burner head assembly 55 includes an inverted manifold 56, generally formed from steel or other similar high strength, heat resistant materials that can withstand the heat of the combustible gas mixture being burned. The manifold 56 includes a downwardly facing, central intake 57 and a series of spaced burner heads or ports 58 through which the combustible gas mixture exits the manifold. It is understood by those skilled in the art that while the present invention as illustrated includes a manifold having two burner heads, larger manifolds with multiple burner heads (i.e. three or four burner heads) for larger gas light assemblies, and with open flow and non-inverted burner heads also can be used, as desired. The manifold is provided with an internal passage 59, shown in dashed lines in FIG. 2, through which the combustible mixture is fed to the burner heads 58. The burner heads include ports or openings (not illustrated) at which are received downwardly extending burner tips or nozzles 61. The burner tips/nozzles 61 are typically formed of a ceramic or other heat resistant material, and are threadably attached to the burner heads. Each of the burner tips defines an internal passage through which the combustible mixture exits the manifold. Mantels 62 are mounted on the burner tips and surround the discharge ends of the burner tips. The mantels 62 generally are formed of a wire mesh, typically from a metal such as steel, aluminum, or similar heat resistant materials that are porous so as to enable the combustible mixture to pass therethrough. As the combustible mixture passes through the mantels, it is ignited and burned to provide illumination.

As shown in FIGS. 1 and 2, the burner head assembly 55 is mounted on an ignitor assembly 65 that connects the burner head assembly to the gas supply line 12 (FIG. 1) for supplying the combustible air-gas mixture to the burner head assembly, and for igniting the combustible mixture at the mantels 62. The ignitor assembly 55 is connected to the gas supply line 12 (FIG. 1) by a connector 67 and includes an orifice seat 68 and a central orifice 69 at which a mixing chamber 71 for the ignitor assembly 65 is mounted. As the gas is fed through the gas supply line, the gas is discharged through the central orifice 69 into the mixing chamber 71. The mixing chamber 71 includes a gas inlet (not shown) that communicates with the orifice and a series of circumferentially spaced intake ports 72. Air is drawn into the mixing chamber through the intake ports 72 as the flow of gas is urged through the mixing chamber, which causes the air and gas to be mixed together to form the combustible mixture supplied to the burner head.

A venturi tube 73, which is an upstanding, hollow cylinder or tube formed from metal such as steel or other durable, heat-resistant materials, is mounted to and receives the combustible gas mixture from the mixing chamber, and extends upwardly through the base of the lamp 46. As indicated in FIGS. 1–3, the venturi tube includes a lower end 74 connected to and communicating with the mixing chamber 71, spaced upper end 76, an outer side wall 77, and a conically shaped inner side wall 78 (shown in dashed lines). The inner side wall 78 of the venturi tube tapers from the upper end 76 thereof toward its lower end 74 so as to form a fluted passage 79 (shown in dashed lines) that expands outwardly as it extends toward the upper end of the venturi tube. The passage includes a nozzle 81 and an expansion chamber 82 through which the gas is drawn and its volume expanded. As known, the venturi tube causes the velocity of the combustible gas mixture to be increased as the volume of the gas expands as it is drawn into, and moved through the venturi tube, and is discharged into the burner head assembly 55.

An ignitor ring 85 connects to the upper end 76 of the venturi tube 73, such as by a threaded attachment or similar connection. The ignitor ring generally is formed from a material such as steel or similar heat-resistant materials, typically the same material as the venturi tube and mixing chamber, and includes an open lower end 86 that receives and attaches to the upper end of the venturi tube, and an open upper end 87 that connects to the central intake 57 of the manifold 56 of the burner head assembly 55 as illustrated in FIG. 2. The ignitor ring also includes a substantially cylindrical outer side wall 88 and an inner side wall 89 (shown in dashed lines) that define an internal passage 91 (shown in dashed lines) through which the combustible mixture is discharged into the manifold of the burner head assembly.

A series of slits or openings 92 and 92' are formed transversely through the inner and outer side walls 88 and 89 of the ignitor ring, and are spaced vertically from one another, approximately 0.1 inches apart. It will be understood that while a pair of slits 92 and 92' are shown, additional slits also can be formed as desired. The slits are formed about the ignitor ring so as to slightly overlap one another and are of a sufficient size to enable a small quantity or portion of the combustible mixture being passed through the ignitor ring to migrate or escape outwardly through the slits to the outer periphery of the ignitor ring where the air-gas mixture is ignited by an electrical spark for causing the ignition of the combustible mixture at the mantels 62 of the burner head assembly 55. Preferably, the slits have a uniform width of approximately 0.018 inches to 0.02 inches, and extend circumferentially about the ignitor ring through an arc of approximately 110° to 120° with their ends overlapping by approximately 0.01 to 0.015 inches. The width of the slits 92 and 92' is designed such that once the combustible mixture flowing through the mantels is ignited and begins to burn, the draw of the combustible mixture through the ignitor ring and burner head will be such that the flow of the combustible mixture through the ignitor slits will be substantially halted so as to extinguish the ignition of the combustible mixture at the slits and will prevent further combustion at the ignitor ring slits.

As shown in FIGS. 1 and 2, a sparking device 95 is mounted along the venturi tube and ignitor ring by a bracket or clamp 96 that clamps about the outer side wall 77 (FIG. 2) of the venturi tube 73 and to the sparking device 95. The sparking device 95 generally includes an electrode 97 supported in an insulated housing 98 positioned adjacent the lowermost of the ignitor slits 92. The electrode is connected to an electrical power source by a cable or wire 99 and, when a sufficiently high voltage potential is applied between the electrode 97 and the ignitor ring 85, a spark is generated therebetween which generally is sufficient to ignite the small quantity of the combustible mixture passing through the slits 92 and 92'. The operation of the sparking device is controlled by the electronic control system 11 (FIG. 1) and is linked to the sparking device through the wire or cable 99.

Figure 4:
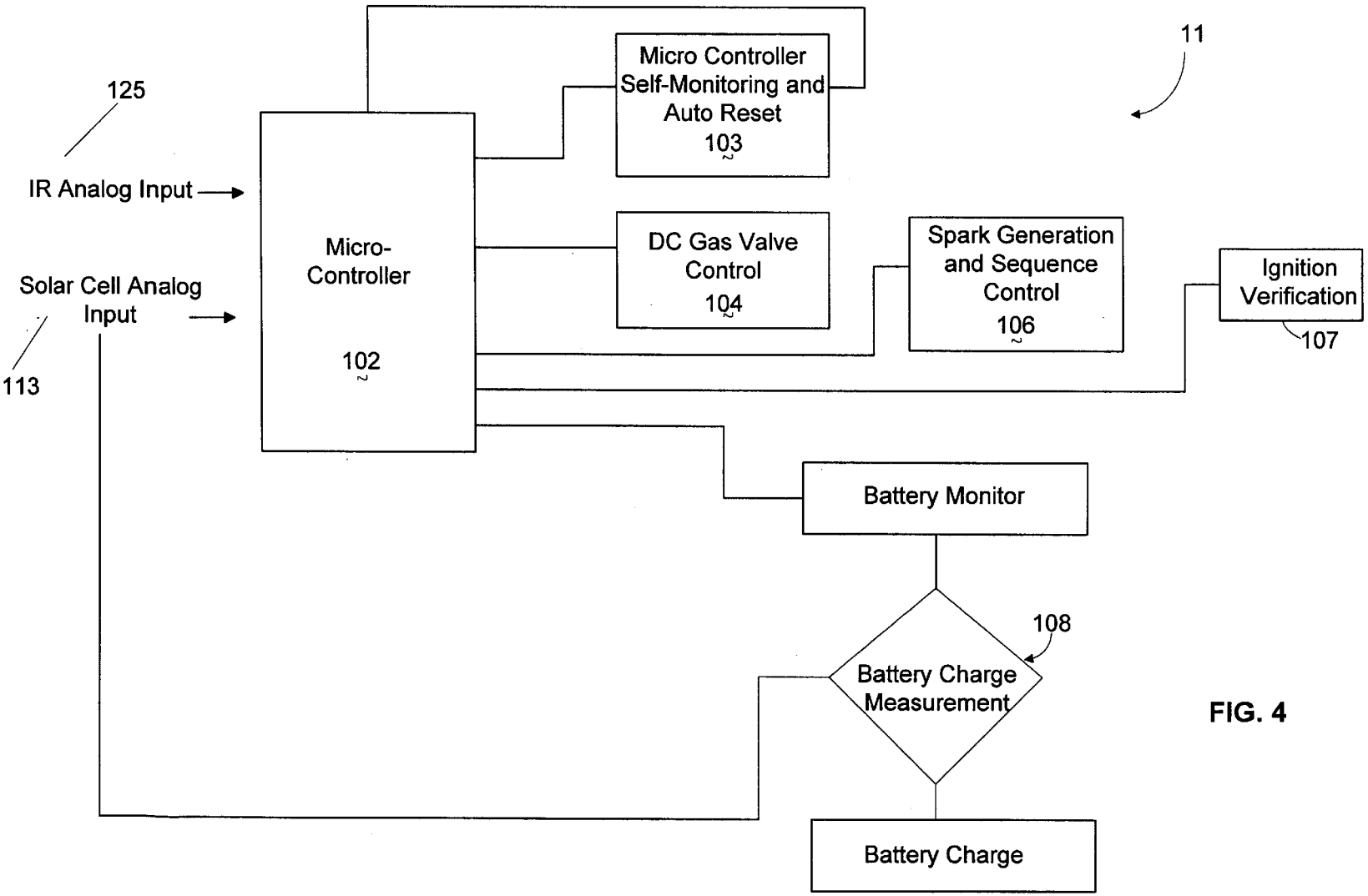
FIG. 4 is a functional flow diagram of the electrical control system of the gas light assembly illustrated in FIGS. 1–3.

The electronic control system 11 of the gas light assembly is illustrated generally in FIGS. 1 and 4. The electronic control system includes an electrical circuit board 101 (FIG. 1) mounted within the adapter collar 32 at the cut-out portion 42 thereof to enable access to the circuit board through the cutout. A series of electrical circuits are formed on the circuit board 101 for controlling the various operative assemblies of the gas light assembly 10, which includes the control of the flow of gas to the burner head, ignition of the gas, and to monitor the system to ensure that the gas light assembly is lit in dark ambient light conditions and is turned off in "light" ambient light conditions. The electronic control system also includes a micro-controller 102 mounted to the circuit board 101 for controlling the operation of the gas light assembly. The electronic control system further includes a self-monitoring circuit with automatic reset 103 (FIG. 4) that monitors the operation of the micro-controller and automatically resets the system if a fault condition is detected, a direct current gas valve control circuit 104 for controlling the operation of the gas control valve 13 (FIG. 1), a spark generation circuit 106 for controlling the operation of the sparking device 95 (FIG. 1), an ignition verification circuit 107 (FIG. 4), and a battery monitoring and charging circuit 108. As shown in FIGS. 1 and 3, a battery 111 is connected to the electronic control system via connectors or wires 112. The battery typically is a six-volt rechargeable battery, such as a Power Sonic PS610 or similar power cell, and acts as a power source for electronic control system 11, and for powering the various operative elements of the electronic control system such as the spark generation circuit and the gas valve control circuit.

A solar cell 113 or a photocell is mounted adjacent and connects to the circuit board 101. The solar cell generally is a photogalvanic solar cell or photocell, such as a Solarex SA-0640, that performs the dual function of detecting the level of ambient light, and emitting a light level detection signal to the micro-controller to initially set the dark and light ambient light conditions or states that act as the thresholds for igniting and extinguishing the gas light assembly. The solar cell also provides a power source for re-charging the battery 111 when a low charge condition is detected in the battery by the battery monitoring and charging circuit 108 (FIG. 4). The solar cell is mounted within a housing 114 (FIG. 1) attached to the outer side wall 38 of the adapter collar 32, with the solar cell being oriented at an angle so as to face upwardly for optimally detecting the current ambient light condition. The housing generally is formed from a weather resistant plastic or similar durable, weather resistant material, and typically includes a front panel or cover 116 formed from a transparent material such as glass or Plexiglas. The front panel acts as a removable access door through which the electronic control system can be accessed as needed.

The electronic control system 11 is connected to the various controlled components of the gas light assembly, such as the gas control valve and the sparking device via cables or wiring 117 and 99. A trigger coil 118 or charge generator is mounted to the circuit board 101 and connects to the battery so as to receive both voltage and current from the battery 111. The micro-controller controls the trigger coil such that when a dark condition or state is detected by the solar cell, the micro-controller engages the trigger coil which enhances the voltage and current from the battery to generate a high voltage charge potential to the electrode 97 of the sparking device 95 via wires 99, to thereby provide a spark at the gap between the ignitor ring and electrode tip for igniting the combustible gas mixture at the burner head assembly. A ground boss 119 is connected via ground wire 121 to the circuit board to provide a grounding connection for the circuit board.

An infrared sensor 125 (FIGS. 1 and 2) is mounted below the burner head assembly 55, attached to the venturi tube 73 by a clamp or bracket 126, so as to fix the infrared sensor in a position sufficiently spaced from the burner head assembly to detect the ignition of the combustible mixture at the mantels of the burner head assembly. The infrared sensor typically is a phototransistor or light receiving photo-diode, the cathode of which is grounded at the ground wire connection 121 and the anode of which is connected to the spark generation circuit 106 via a cable or wire 127. The sensor 125 detects light from the mantels when the combustible gas mixture is ignited and emits a signal via wires or cables 127 to the micro-controller through the ignition verification circuit 107 which, if the gas light assembly is supposed to be lit, engages the sparking device. If the mantels are not supposed to be lit, the micro-controller will engage the gas control circuit to close the gas control valve and shut down the system. If the sensor 125 does not detect light from the mantels in approximately 60 to 100 seconds from the time the mantels should be lit, the sparking cycle is timed out, the system is reset, and the sparking generation and ignition sequence is activated for a second time. After a pre-determined number of unsuccessful attempts to ignite the mantels the ignition sequence will be terminated until the system is reset. The ignition verification circuit is also designed such that even if a high level of infrared radiation is detected by the sensor 125 at the same time the micro-controller detects a light to dark transition, the spark generation circuit still can be activated to start an ignition and sparking sequence for a prescribed period of time to enable testing of the system during daylight conditions when high levels of infrared radiation are present due to solar energy, for example.

The electronic control system of the present invention is designed such that the spark generation circuit can function at battery voltages much lower than that of typical conventional gas light assemblies. In addition, the gas valve control circuit is designed to still operate when charge levels in the battery fall to as low as 60%. The sparking device, however, generally will be rendered inoperable at such levels with the result that the spark generation circuit will become inoperable before the gas control valve circuit is rendered inoperable due to the low charge condition of the battery. The micro-controller will function reliably at voltage levels much lower than the threshold charge levels for the spark generation circuit and the gas control valve circuit. As a result, as long as the micro-controller does not detect ignition of the mantels, such as when the sparking device is rendered inoperable due to the charge levels in the battery being too low to produce a sufficient potential to initiate a spark, the gas control valve can still be closed by the micro-controller through the gas valve control circuit to prevent the waste of gas and/or a buildup of gas in the lamp of the gas light assembly.

Figure 5:
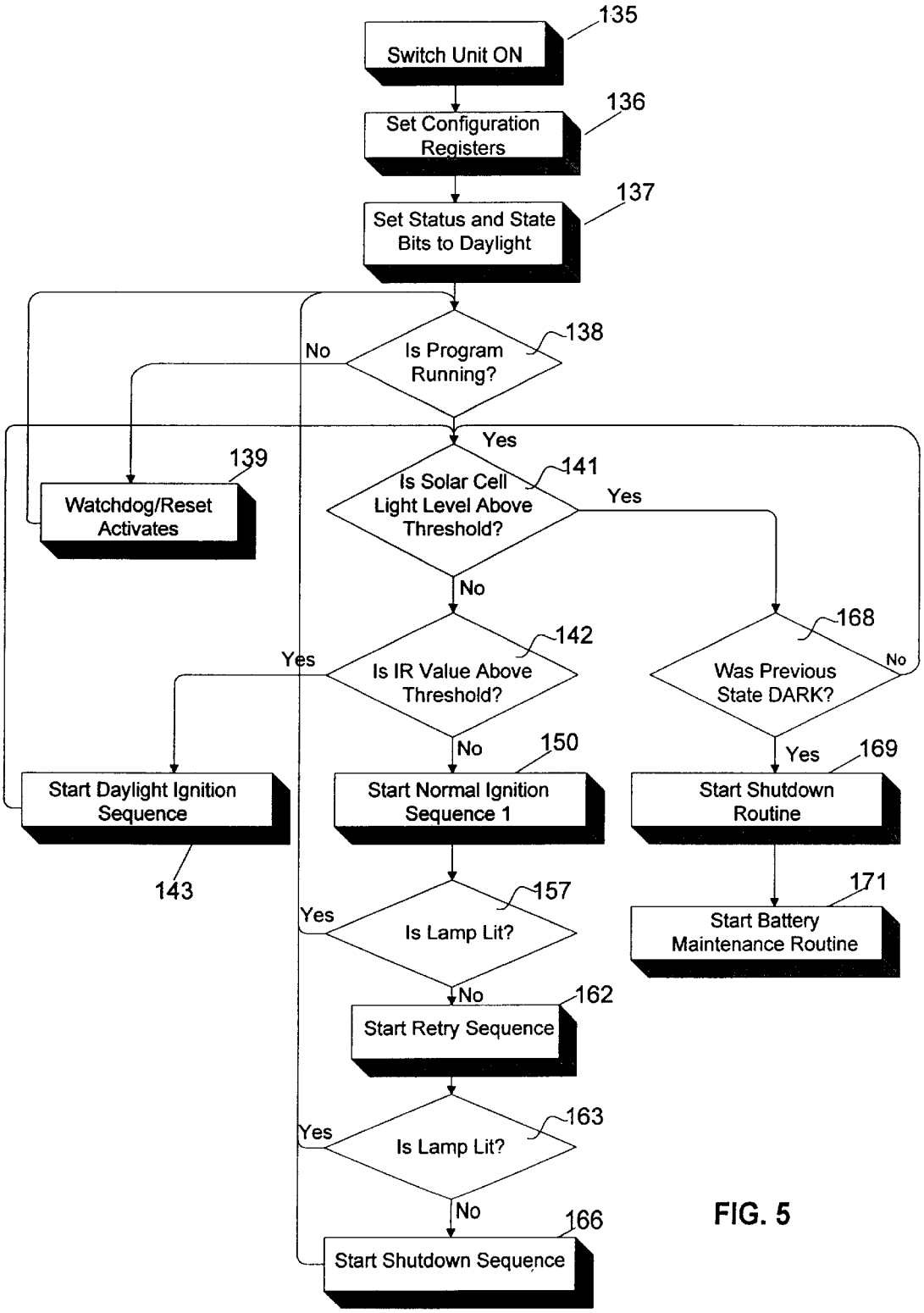
FIG. 5 is a flow diagram illustrating the control operation of the gas light assembly of FIGS. 1–3.

FIGS. 5 and 6A–6D illustrate the sequence of operational steps executed by the micro-controller 102 for the operation of the gas light assembly of the present invention. As illustrated in FIG. 5, after installation of the gas light assembly on-site, the system is activated in an initial step 135 by the engagement of a control switch 9 (FIG. 1). In step 136 (FIG. 5) the micro-controller sets its configuration registers, and in step 137 receives inputs from the solar cell 113 (FIG. 1) to set the status of the system and establish a daylight or light ambient light state or condition as the initial state for the gas light assembly. The control program thereafter substantially continuously monitors the status of the inputs from the solar cell 113, which is providing periodic inputs corresponding to the level of ambient light in the surrounding area, and further monitors the status of the charge levels in the battery 111 for the system so as to shut down the gas light assembly when charge levels in the battery fall below a desired threshold to avoid opening of the gas valve and wasting of gas when there are insufficient charge levels initiate a sparking sequence. In step 138, the micro-controller sends a pulse to the independent self-monitoring circuit indicating that the control program is currently running.

If this pulse is not sent, indicating that the control program is not in operation, the self-monitoring circuit sends a reset pulse to the micro-controller after a prescribed time to automatically reinitialize or reset the micro-controller as indicated in step 139 (FIG. 5). If the program is found to be running in step 138, the next step of operation for the micro-controller is step 141 in which the input from the solar cell, indicating the level of ambient light is compared to the threshold level or state previously established in the micro-controller in step 137. If this light level is determined not to be above the threshold level, the system proceeds to step 142 in which the micro-controller monitors the ignition verification circuit 107 (FIG. 4) to determine if the infrared radiation level being detected by the infrared sensor 125 (FIG. 1) is above an established acceptable threshold level. If the measured infrared radiation level is above the threshold, the daylight ignition sequence 143 (FIG. 5) of the system can be engaged, as discussed in greater detail with regard to FIG. 6D below. If the infrared radiation level measured by the sensor is below the established threshold level, the system proceeds to the next operative step, step 150, wherein the normal ignition sequence is started.

Figure 6A:
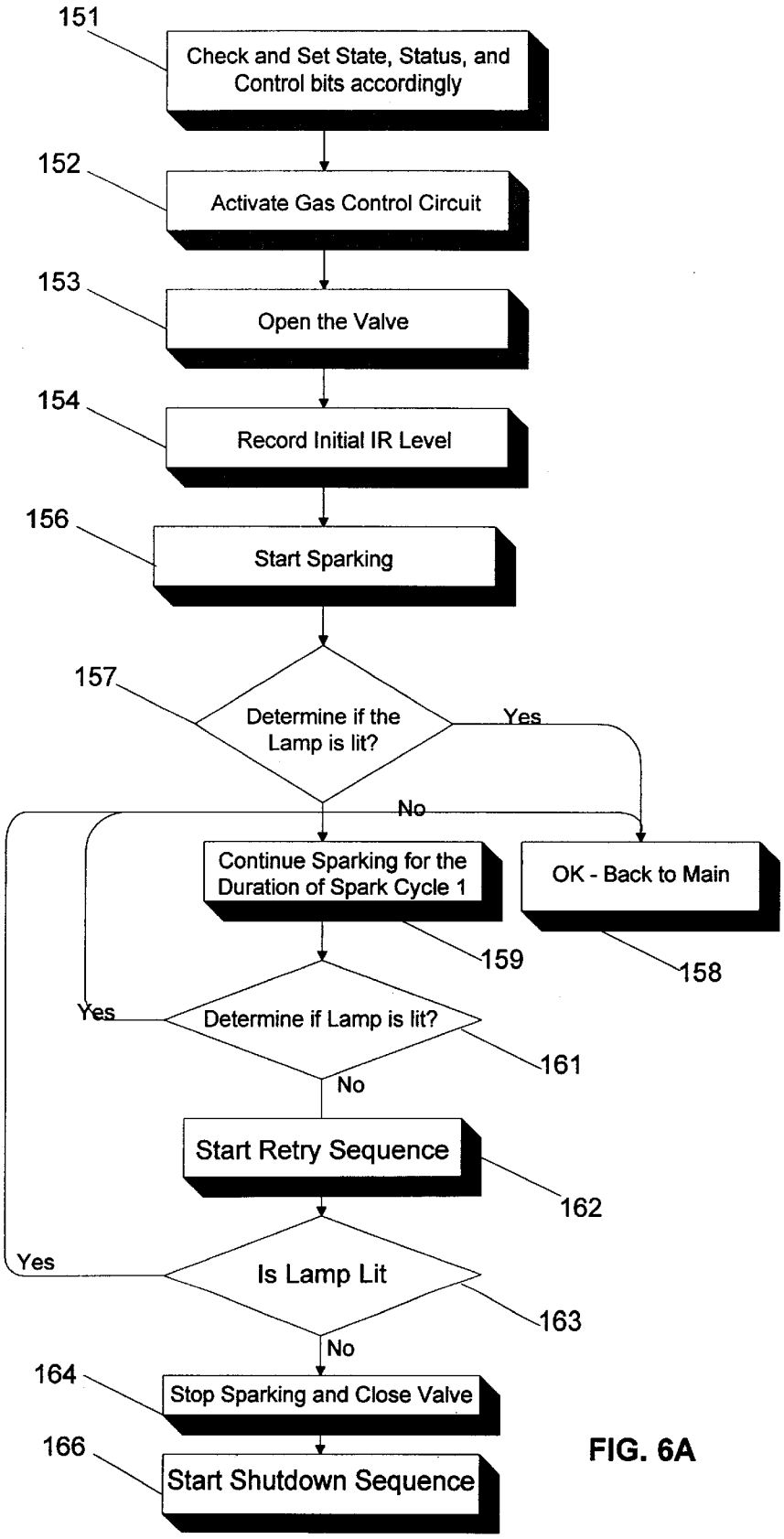
FIG. 6A is a flow diagram illustrating the ignition sequence of the gas light assembly of FIGS. 1–3.

The normal ignition sequence is illustrated in FIG. 6A. In step 151 the system first checks the state and status of the valve control circuit, spark generation circuit, and the ignition verification circuit. Thereafter, in step 152, the gas control circuit is activated so as to cause the gas control valve to be opened, as indicated in step 153, to start the flow of gas through the gas supply line and into the ignitor assembly 65 (FIG. 1) and burner head assembly 55. In step 154, the micro-controller receives and records an initial infrared radiation level at the lamp or lantern from the sensor 125 via the ignition verification circuit 107 (FIG. 4). Thereafter, the micro-controller initiates a sparking sequence as indicated in step 156.

The sparking sequence typically is carried out in approximately two-second intervals for a pre-determined time, typically is a time period of from sixty to one-hundred seconds, although longer or shorter time periods can be programmed into the micro-controller. The micro-controller continues to monitor the level of infrared radiation via the ignition verification circuit as shown in step 157 (FIG. 6A) to determine if the lamp of the gas light assembly is lit. When an increase in infrared radiation is detected that is acceptable, i.e. above a programmed threshold level, the spark generation sequence is stopped and the micro-controller returns to its monitoring operation as indicated by step 158. If the increase in the level of infrared radiation is not acceptable, i.e. it is not above the programmed threshold level, the spark generation sequence continues in step 159 for the duration of the generation cycle. At the end of the initial sparking cycle, the level of infrared radiation is monitored to determine if the lamp is lit, as indicated in step 161. If the lamp is found to be lit at this time, the spark generation sequence is deactivated and the micro-controller 102 (FIG. 4) returns to its monitoring condition or state in step 158.

If the lamp is found not to be lit, i.e. infrared radiation levels are still not above the acceptable threshold, a retry sequence 162 is initiated, resetting the spark generation circuit 106 (FIG. 4) and again activating a sparking routine during which the lamp is monitored as indicated in step 163 (FIG. 6A) to determine if the levels of infrared radiation have reached an acceptable level. If the lamp is found to be lit, the spark generation circuit is deactivated and the micro-controller resumes its monitoring function. If the lamp is still not found to be lit after the end of the second sparking routine, or after additional sparking sequences have been tried, if so desired, the micro-controller deactivates the spark generation circuit, stops the sparking sequence, and closes the gas control valve in step 164. The system is then shut down and indicates that a fault condition has been detected such that a shut down sequence in step 166 is executed. Thereafter, no further attempts at lighting the mantels will be made until the program sequences through a complete dark to light, and back to a dark cycle.

Figure 6B:
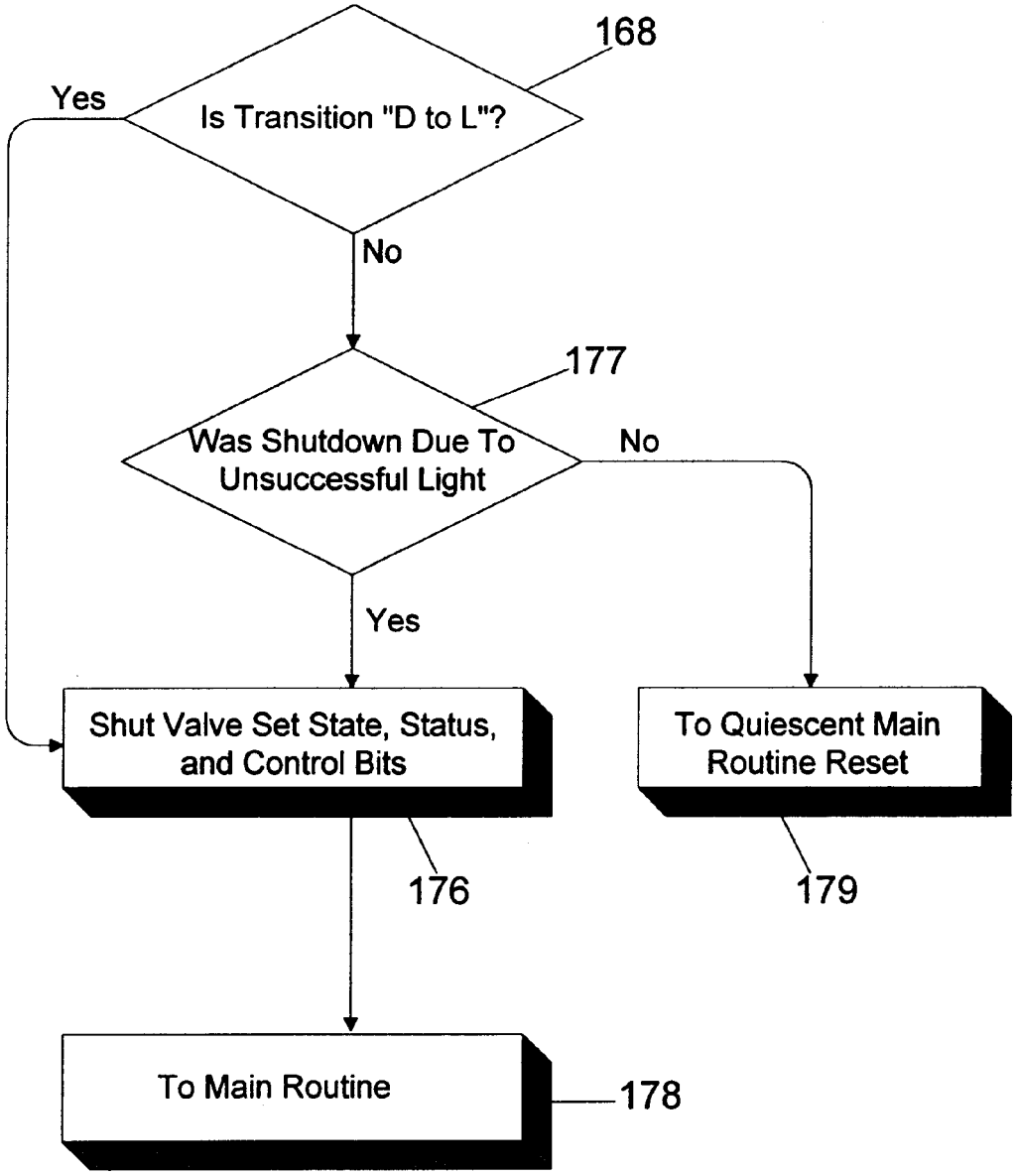
FIG. 6B is a flow diagram illustrating the operation of the shutdown sequence of the gas light assembly of FIGS. 1–3.

As shown in FIG. 6B, should the combustible mixture fail to ignite at the mantels after a pre-determined number of attempts at ignition have been tried, the system begins the shutdown routine or sequence of as indicated in step 166 in FIG. 5. In addition, during the normal operation of the control program, if the ambient light level detected by the solar cell in step 141 is detected above the established threshold level, the system checks to see if a previous state of the ambient light detected by the solar cell was dark as indicated in step 168 (FIG. 6B). If not, the micro-controller continues to monitor the light level being detected by the solar cell and the continued operation of the control program. If the previous state of the ambient light surrounding the gas light assembly as detected by the solar cell was a dark state or condition, the system proceeds to a system shutdown as indicated in step 169 and executes a battery maintenance routine indicated in step 171.

When the shutdown sequence for the control program illustrated in FIG. 6B is executed, the system initially determines if the shutdown sequence is engaged as a result of a transition from a dark to a light state as indicated in step 175 and if so, the system proceeds to shut down the gas control valve and reset the state and status of the system in step 176. If the shutdown sequence has been engaged due to a fault condition being detected instead of a transition from a dark to a light state, the system proceeds to step 177 in which it is determined whether the shutdown sequence was engaged due to an unsuccessful attempt to light the lamp. If so, the system proceeds to step 176 in which the gas control valve is closed or shut down, the system status is reset to a shutdown state after which the micro-controller is returned to its normal operating routine in step 178. If, in step 178, it is determined that the shutdown sequence was activated in response to a fault condition instead of an unsuccessful attempt at lighting the gas light assembly, a fault condition is indicated and the system is reset as indicated in step 179.

Figure 6C:
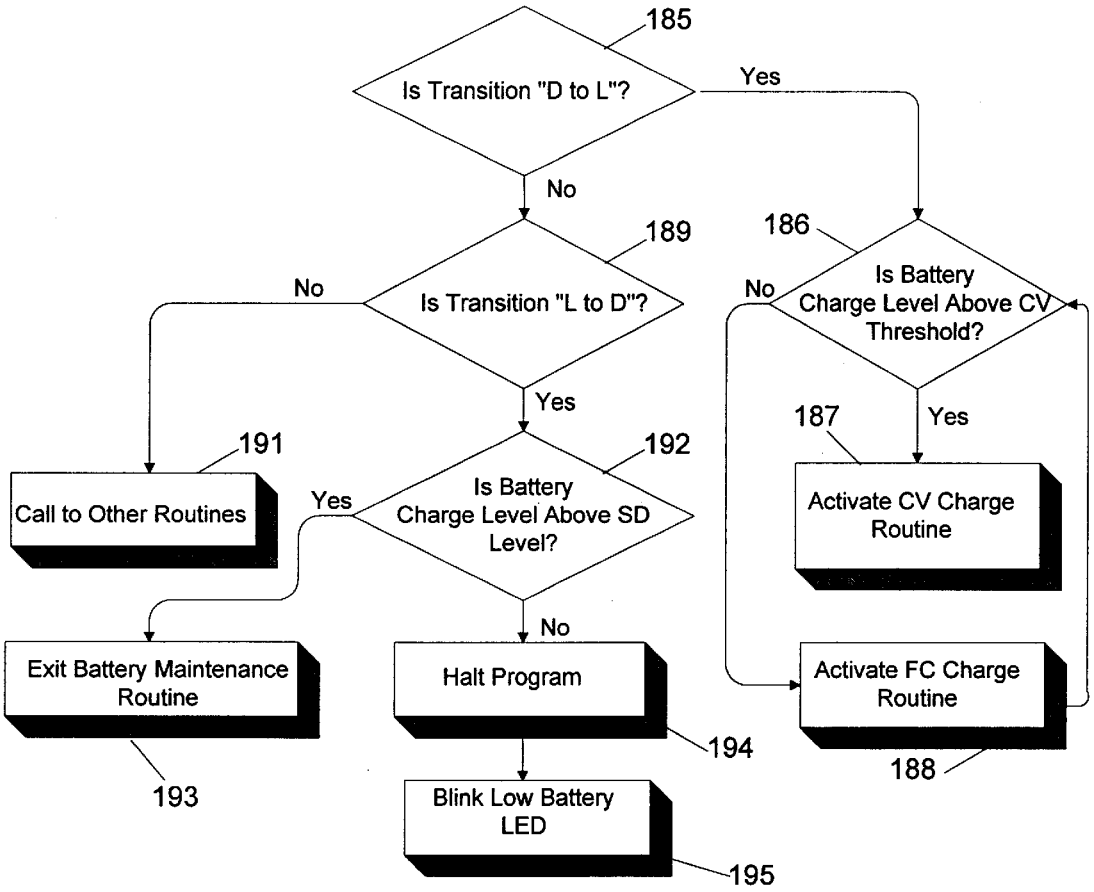
FIG. 6C is a flow diagram illustrating the battery maintenance and charging operation of the gas light assembly of FIGS. 1–3.

The battery maintenance routine executed by the micro-controller through the battery monitoring and charging circuit for recharging the battery during daylight hours is illustrated in FIG. 6C. In step 185 the system first determines if a transition in the detected light condition indicated by the input from the solar cell indicates a transition from dark to light. If so, the system proceeds to step 186 wherein the battery monitoring and charging circuit monitors and detects the charge level in the battery to determine the most optimum method of re-charging the battery. If the battery charge level is above a constant voltage threshold of approximately 7.35 volts DC, a constant voltage charge routine in step 187 is executed to charge the battery at a constant rate via the solar cell. If the charge level in the battery is not above the constant voltage threshold level, a full rate charge routine 188 is activated so as to charge the battery at a full rate based on the capacity of the solar cell. As a result, the battery can be charged according to its needs at either a constant voltage or to the capacity of the solar cell.

If the initial determination in step 185 is made that there was not a transition from a dark state to a light state which executed the battery maintenance routine, the system resets and makes a determination in step 189 whether there has been a transition from a light state to a dark state. If not, the control program polls the other subroutines to determine if a fault condition exists and the system needs to be shut down as indicated in step 191. If there has been a transition from light to dark detected in step 189, the program then monitors the battery charge level in step 192 to determine if it is above the threshold level for activating the sparking device 95 (FIG. 1). If the battery charge level detected in step 192 (FIG. 6C) is above the charge level required for the sparking device, the battery maintenance routine is exited in step 193 and the micro-controller reset back to its normal operation as illustrated in FIG. 5. Should the battery charge level be detected as being below the threshold level required for actuation of the sparking device, the control program is interrupted in step 194, and a low battery indicator, such an LED or similar signaling device, is actuated in step 195 to indicate that the battery needs charging or replacing.

Figure 6D:
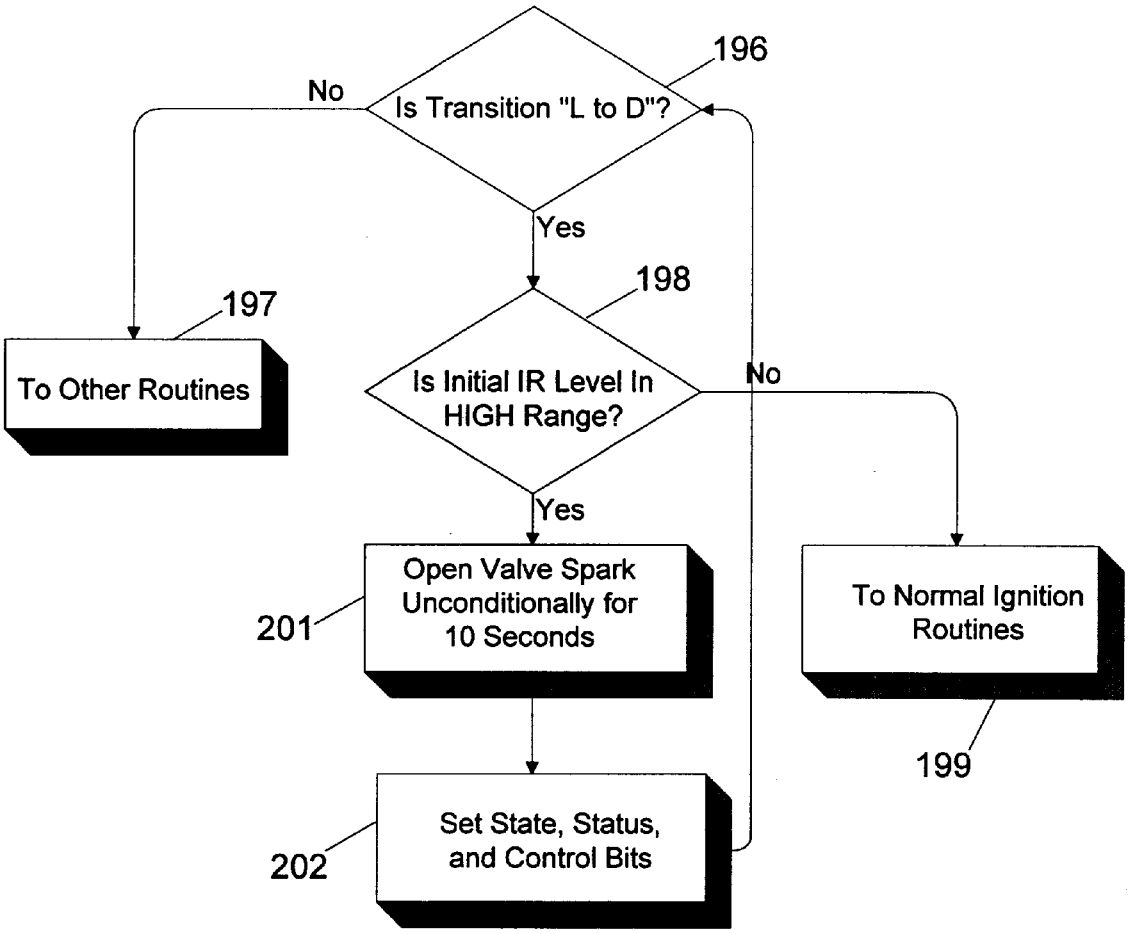
FIG. 6D is a flow diagram schematically illustrating the operation of the daylight ignition sequence of the gas light assembly of FIGS. 1–3.

FIG. 6D illustrates the daylight ignition sequence for the gas light assembly of the present invention so as to enable testing and the initialization of the system. Typically during the testing of the unit during daylight hours, solar infrared radiation will be detected by the infrared sensor 125 (FIG. 1). During normal operation of the control program, the program logic would inhibit ignition sequence under conditions where sufficient levels of solar infrared radiation are detected. However, to provide for testing of the unit, which typically would take place during daylight hours, the control program provides for a ten-second unconditional sparking routine even when infrared radiation levels are high upon the transition from a light to a dark state or condition. This testing can also be accomplished by covering the solar cell to initiate the ignition sequence.

As illustrated in FIG. 6D, therefore, in initial step 196 the input from the solar cell is monitored to detect whether there has been a transition from a light to a dark state. If not, the system continues to monitor the other control routines as indicated by step 197. If a transition from light to dark has been detected, i.e. by covering the solar cell, the program next determines whether the initial infrared radiation level detected by the infrared sensor and ignition verification circuit is in a high range or above a desired threshold level in step 198. If not, the system proceeds with a normal ignition sequence as indicated in step 199. If the infrared radiation level is detected to be in a high range above the pre-determined or set threshold level, the gas control valve is opened and the spark generation sequence or circuit is executed to cause the sparking device to spark unconditionally for approximately ten seconds as shown in step 201. Thereafter, in step 202, the system sets its status control levels in the micro-controller and is reset to its normal operation sequence as illustrated in FIG. 5.

It is understood by those skilled in the art that each of steps 135 to 202 shown in FIGS. 5–6D represent executable blocks of programmable code, where appropriate, executed by micro-controller 102 (FIG. 4). Although not illustrated, micro-controller 102 includes a readable memory, for example an EEPROM or other electronic memory storage device, within which the control program and the several sub-routines thereof are stored. The micro-controller 102 generally comprises a P1C16C711-04 I/P processor produced by MICROCHIP, or its equivalent, programmed in the instruction set language for this family of devices, or other suitable computer programming languages intended for machine, in this instance a gas light assembly, operation.

Therefore it can be seen that the gas light assembly of the present invention provides a gas light assembly that is highly reliable, safe and extremely user friendly and easy to install. The micro-controller based control system further demands very low voltage or current and is able to substantially constantly monitor the state of the system rather than detect one-time changes in state conditions and automatically can be reset if necessary. In addition, the current levels for the operation of the micro-controller and gas valve control circuit are set at levels below the operational voltage levels for the sparking device of the system so that the gas valve can be closed or shut down to halt the flow of gas into the gas light assembly and thereby conserve fuel and prevent a build-up of gas in the lamp of the gas light assembly in the event that charge levels in the battery become too low to create a spark. The system further has the ability to measure the voltage level of the battery and charge the battery according to its needs at either a constant voltage or at a full rate according to the capacity of the solar cell.

It will be further understood by those skilled in the art that the present invention has been disclosed with respect to a preferred embodiment, numerous variations, changes and modifications can be made thereto without departing from the spirit and scope of the present invention as set forth in the following claims. In addition, the corresponding structures, materials, acts, and equivalents of all means or step plus function elements in the claims are intended to include any structure, material, or act for performing the functions in combination with other claimed elements, as specifically claimed herein.

I claim:

1. A gas light assembly, comprising a burner head assembly;

a venturi tube connected to said burner head assembly and through which a flow of combustible air-gas mixture is supplied to said burner head assembly;

an ignitor ring mounted between said venturi tube and said burner head for igniting the combustible mixture at said burner head assembly;

said ignitor ring having a series of ignition slits defined therein to enable a portion of the combustible mixture flowing to said burner head assembly to be ignited, said slits being configured such that as the combustible mixture at said burner head assembly is ignited, the flow characteristics of the combustible mixture flowing through said venturi tube and ignited at said burner head assembly eliminate further combustion thereof at said slits;

a gas control valve mounted along said venturi tube for controlling the flow of the combustible mixture to said burner head assembly;

a sparking device for igniting the combustible mixture at said ignitor ring, positioned adjacent said ignitor ring;

a detector for detecting dark and light ambient conditions;

a controller for controlling the operation of said gas control valve and said sparking device in response to inputs from said detector and for monitoring the operation of the gas light assembly to detect fault conditions; and a battery for supplying an electrical charge to said sparking device and a monitoring and charging circuit connected to said controller for monitoring charge levels and charging said battery at varying rates upon detection of a low charge condition.

2. The gas light assembly of claim 1 and wherein said burner head includes a plurality of mantles through which the combustible mixture is discharged for ignition.

3. The gas light assembly of claim 1 and further including a mixing chamber in which a gas material is mixed with air, connected to said venturi tube.

4. The gas light assembly of claim 1 and further including an adapter collar constructed and arranged to mount the gas light assembly to a support.

5. The gas light assembly of claim 1 and further including a sensing means for detecting infrared radiation at said burner head, said sensing means being connected to said controller for indicating a lit and an unlit condition of said burner head.

6. The gas light assembly of claim 1 and wherein said controller comprises a microprocessor.

7. The gas light assembly of claim 1 and further including a trigger coil connected to said battery and to said sparking device for supplying a charge to said sparking device to generate a spark for ignition of the combustible mixture.

8. The gas light assembly of claim 1 and wherein said controller includes a valve operation circuit for signaling said gas control valve to close upon detection of battery charge levels too low for operation of said sparking device.

9. A method of automatically controlling a gas light assembly, said method comprising the steps of:

detecting ambient light conditions about the gas light and establishing light and dark conditions in response thereto;

as a dark condition is detected, opening a gas control valve to enable gas to flow to a burner head of the gas light;

passing a portion of the gas flowing to the burner head through ignitor slits adjacent the burner head as the gas flows into and through the burner head and out of mantles for the burner head assembly;

after a predetermined delay, igniting the portion of the gas passing through the ignitor slits;

igniting the gas flowing through the mantles with the gas ignited at the ignitor slits;

monitoring ambient light conditions and the ignition of gas at the mantles and engaging a sparking device and gas control valve to open a gas flow to the burner head and to create a spark to ignite the gas, and to close the gas control valve and stop the gas flow upon detection of a shutdown condition; and monitoring a battery connected to the sparking device and shutting the gas control valve upon detection of a battery voltage below a desired level.

10. The method of claim 9 and further including the steps of periodically monitoring the battery and charging the battery when a low voltage condition is detected.

11. The method of claim 9 and further comprising the steps of sending an input to a reset circuit to indicate normal operation of the gas light, and if the input is not provided to the reset circuit, automatically generating a reset signal to reset the operation of the gas light assembly.

12. The method of claim 9 and further comprising the steps of detecting the ignited condition of the mantles, and if the mantles are unlit, initiating an ignition sequence to generate a spark for igniting the mantles and, after a predetermined number of unsuccessful attempts to ignite the mantles, terminating the ignition sequence.

* * * * *